United States Patent [19]

Elcock

[11] Patent Number: 5,012,603

[45] Date of Patent: May 7, 1991

[54] SIGN SYSTEMS

[75] Inventor: Kenneth W. A. Elcock, Hythe, England

[73] Assignee: Esselte Letraset Limited, United Kingdom

[21] Appl. No.: 314,638

[22] Filed: Feb. 23, 1989

[30] Foreign Application Priority Data

Feb. 26, 1988 [GB] United Kingdom ..... 8804557

[51] Int. Cl.[5] ..... G09F 15/00

[52] U.S. Cl. ..... 40/605; 40/606; 40/607; 40/574

[58] Field of Search ..... 40/605, 606, 607; 248/295.1; 403/3, 4; 108/152; 211/182, 192

[56] References Cited

U.S. PATENT DOCUMENTS 3,307,280 3/1967 Mazur ..... 40/605 X 4,068,398 1/1978 Parisi ..... 40/607

4,802,296 2/1989 Kovalak, Jr. ..... 40/607

FOREIGN PATENT DOCUMENTS 2137795 10/1984 United Kingdom ..... 40/607

*Primary Examiner*—Peter R. Brown

*Assistant Examiner*—Joanne Bonifanti

*Attorney, Agent, or Firm*—Darby & Darby

[57] ABSTRACT

A modular sign system is disclosed in which signs having various thicknesses can be adjustably mounted on a post. The system comprising a post which has a longitudinally extending slot into which a sign or a plurality of nesting components can be accommodated. Each nesting component can be accommodated to receive either a sign of lesser thickness or another nesting component which may form a spacer between several signs or may itself hold a sign of appropriate thickness.

12 Claims, 3 Drawing Sheets

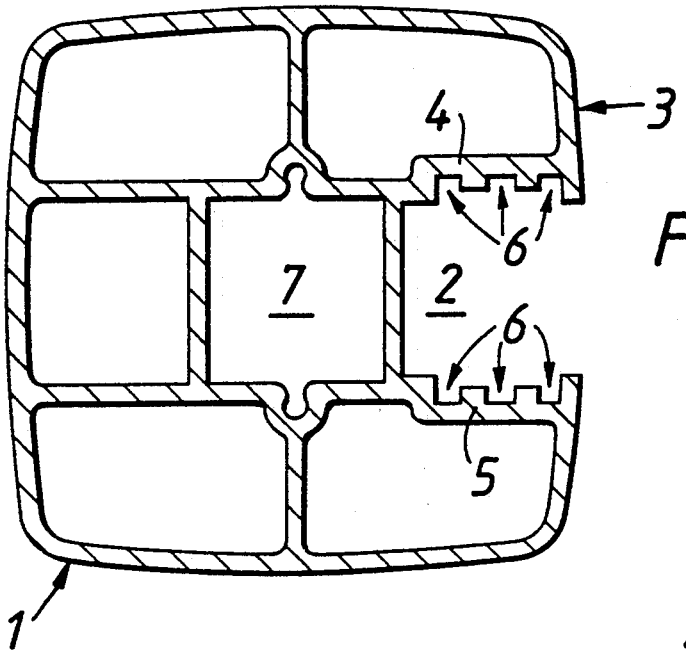
FIG. 1.
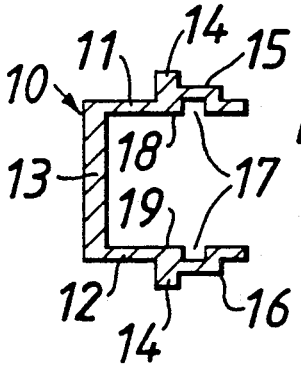
FIG. 2.
FIG. 3.
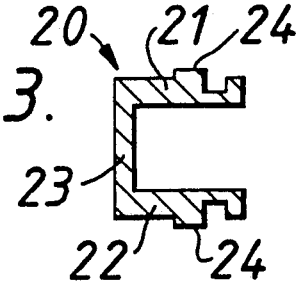
FIG. 4.
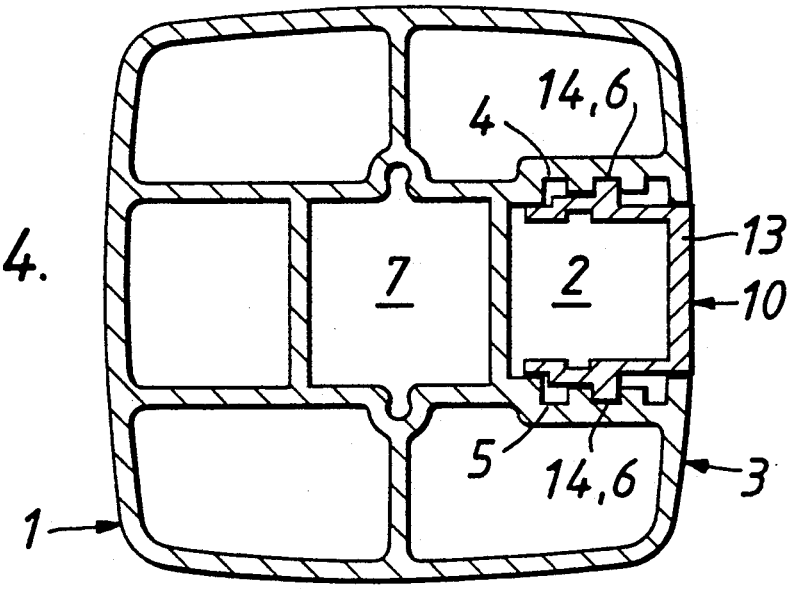

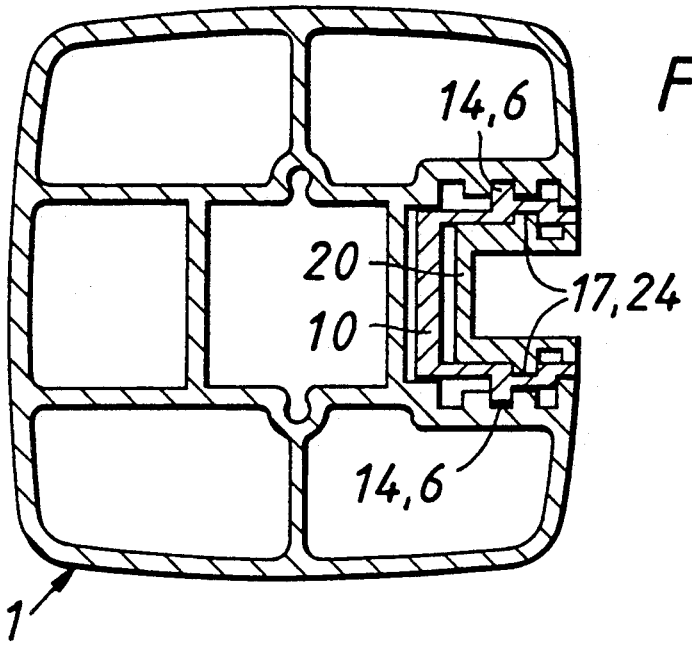
FIG. 5.
FIG. 6.
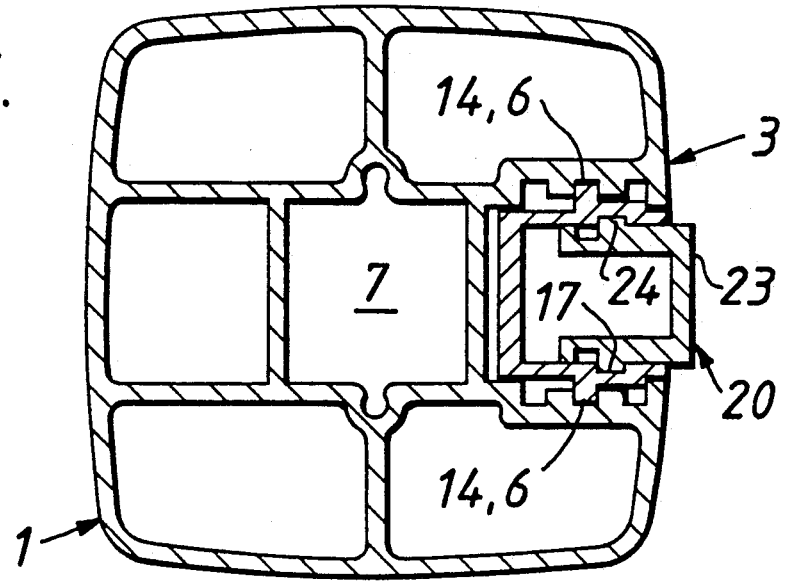

SIGN SYSTEMS

This invention relates to sign systems.

BACKGROUND OF THE INVENTION

In known sign systems, a sign is attached to a supporting post by means of a bracket attached to the sign, which is bolted onto the post. Alternatively, the sign is bolted directly onto the post.

It may be desired that the sign is adjustable with respect to the post. In such a case, the above fixings may prove to be inconvenient to adjust.

Modular sign systems have been proposed in which the sign and post can be easily adjusted relative to one another, the sign being slidable within a slot in the post. Such a modular sign system is disclosed in British Patent Specification GB-A-2137795. The system comprises a post having a plurality of longitudinally extending slots into which signs can be placed. The slots can be of different sizes to enable signs having different thicknesses to be accommodated. However, each post is designed to accommodate only signs of a particular thickness i.e. signs sized to fit the slots.

British Patent Specification GB-A-2100044 discloses a system comprising a post which carries a dovetail slot into which a sign can be slotted. The edges of the sign forming a frame are elongate extrusions into which further smaller signs can be placed. The corners of the frame overlap with one edge portion fitting over an adjacent edge portion. This system is limited in its application as the sign can only be positioned at a given height above a reference, for example the ground, due to the positioning of the dovetail slot on the post. Furthermore, only signs of certain thicknesses can be retained by the extrusions forming the frame of the sign.

U.S. Pat. No. 3,525,493 discloses a bracket arrangement which enables a sign to be mounted on a wall, the bracket having a sleeve of flexible material to retain the sign within the bracket by friction.

None of the above-mentioned systems provides a system which is versatile enough to allow signs of different sizes to be accommodated, or to allow the position of a sign relative to a reference, for example the height of the sign above the ground, to be easily varied.

SUMMARY OF THE INVENTION

In accordance with the present invention, a modular sign system as described above is characterised by a plurality of nesting components which can be assembled to receive at least one sign and to space the or each sign from a fixed reference.

By this arrangement, each component can be used to hold a sign or to space it from another sign or the ground. This has the advantage that the sign system is easy to assemble and can be adjusted to suit any particularly desired configuration.

Advantageously, each component has a constant cross section.

Preferably, the outermost nesting component is a post having a longitudinally extending slot into which a sign or a nesting component is received. This arrangement allows a sign of a given thickness to be mounted directly in the slot, the sign being positioned within the slot at a given height by at least one nesting component or a further sign.

The nesting components may be generally C-shaped and have portions adapted to engage a sign and/or each other. Advantageously, engagement is provided by projections carried by one component of the system fitting into grooves formed in another component. For example, projections formed on a sign engage grooves formed in a component, the component itself having projections which engage with the slot formed in the post, or with grooves formed in another component.

Each of the inner components may be so shaped that it can be assembled reversibly in an adjacent component. This has the advantage that the components can be used one way round to hold a sign or the other way round to space it from the ground, the component having an opening facing outwards in the former case and inwards in the latter case.

The post may have a central cavity into which a pole can be inserted. This may be prismatic to enable the post to take up one of a plurality of positions, e.g. one of four orientations spaced apart by 90°, if the cavity and pole are of square cross section.

In a preferred embodiment of the invention, a modular sign system for accommodating signs of various thicknesses comprises a post having a longitudinally extending slot and being of constant cross section, and a plurality of nesting components, each component being generally C-shaped and having a constant cross section. The components are adapted to fit into the slot either alone or in conjunction with another nesting component so that at least one sign can be received and spaced from a fixed reference or a further sign similarly mounted.

BRIEF DESCRIPTION OF THE DRAWINGS

For a better understanding of the invention, reference will now be made, by way of example only, to the accompanying drawings in which:

FIG. 1 shows a post in cross section;

FIGS. 2 and 3 show two nesting components in cross section;

FIG. 4 shows the FIG. 2 component inserted in the FIG. 1 post,

FIG. 5 shows the two nesting components of FIGS. 2 and 3 inserted in the FIG. 1 post;

FIG. 6 is similar to FIG. 5 but with the FIG. 3 component reversed.

DESCRIPTION OF A SPECIFIC EMBODIMENT OF THE INVENTION

Figure 7:
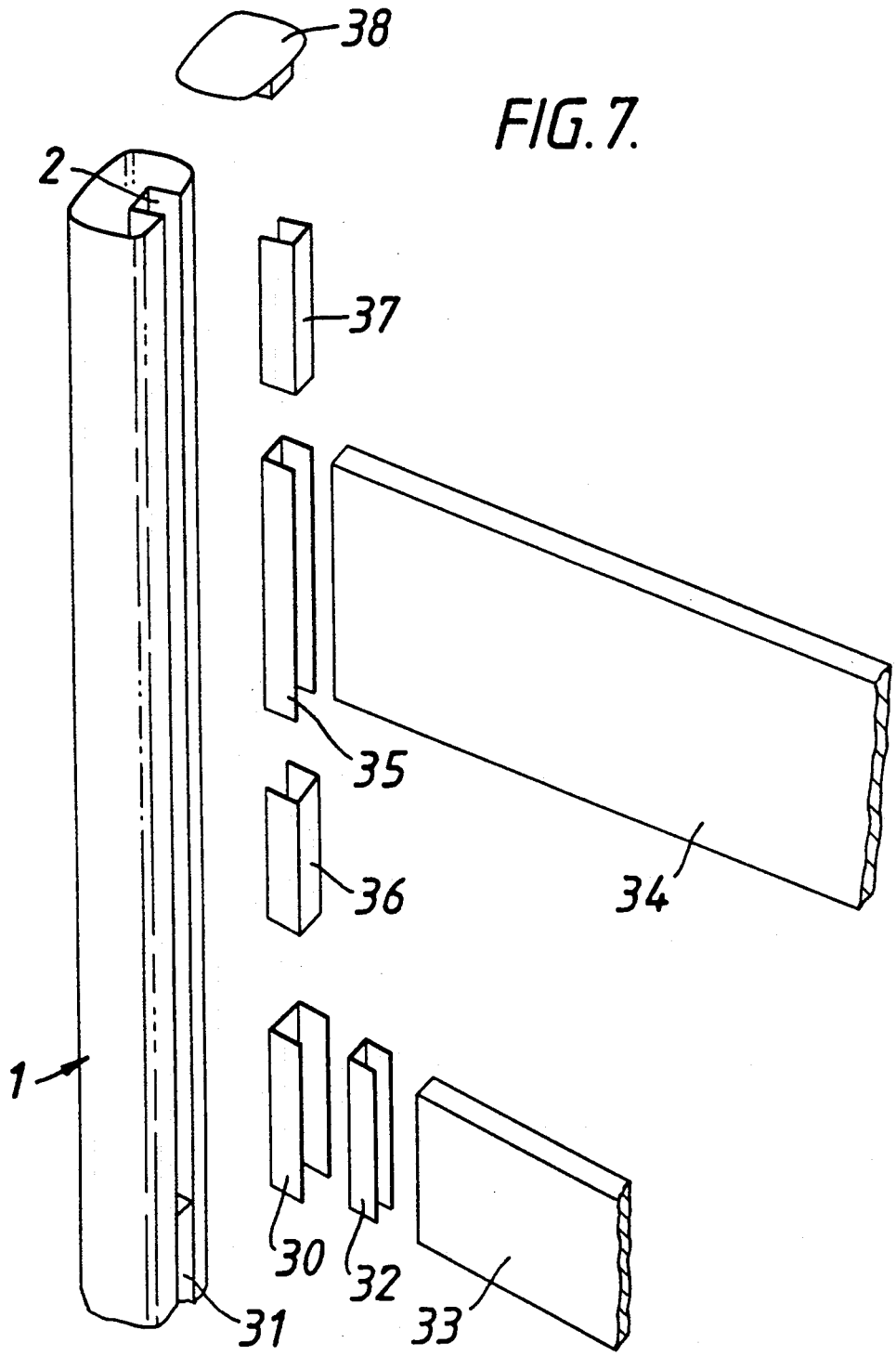
FIG. 7 is a schematic, exploded view of a FIG. 1 post having two signs of different thickness mounted on it.

FIG. 1 shows a post 1 which has generally square cross section with a central square cavity 7. A longitudinally extending slot 2 is formed in one wall 3 of the post 1. Walls 4, 5 of the slot 2 each have three grooves 6 formed therein. The grooves 6 engage with projections on a sign (not shown) if the sign is of such a thickness as to fit the width of the slot 2. By sliding the sign in the slot 2, it can be adjusted to be at any desirable height on the post 1.

If however, the thickness of the sign is much less than the width of the slot 2, one or both of the nesting components shown in FIGS. 2 and 3 may be employed. FIGS. 2 and 3 show two nesting components 10 and 20 respectively which are generally C-shaped and have two limbs (11, 12 and 21, 22) projecting in a direction transverse to a third limb (13, 23). The component 10 has a single projection 14 formed on each of its outer walls 15, 16 of the limbs 11, 12 which engage with the grooves 6 of the slot 2. Grooves 17 are provided, one in each of the inner walls 18, 19 of limbs 11, 12. Similarly the component 20 has projections 24 in limbs 21, 22 which engage grooves 17 of the component 10.

FIG. 4 shows the component 10 in the slot 2 of post 1, the projections 14 in limbs 11, 12 engaging the middle groove 6 in walls 4, 5. The limb 13 in this arrangement fits flush with the wall 3. However, limbs 11, 12 may be shorter than shown in the Figures, enabling the inner grooves 6 to be engaged if so desired. The component 10 can be used in this way to fill the slot 2 when a sign is not present and also to space signs as desired.

FIG. 5 shows the two nesting components 10, 20 in position in the slot 2. The projections 14 engage grooves 6 as before but with the limb 13 near the bottom of the slot. Component 20 is then inserted with projections 24 engaging grooves 17. The gap left between limbs 21, 22 enables an appropriately sized sign to be fitted.

Alternatively, as shown in FIG. 6, the component 20 can be reversed with its limb 23 fitting in the slot nearest the wall 3. Although the limb 23 is not shown fitting flush with the wall 3, by adjusting the positions of the grooves 17 in member 10 and/or moving the positions of the projections 24, this limb can be made to fit flush with the wall 3.

The post 1 and components 10, 20 can be extruded in aluminium, plastics or any other suitable material. Additionally, each component may be of a different colour to match or contrast with the signs.

FIG. 7 shows the post 1 with its longitudinal slot 2. A portion 30 having identical cross section to component 10 is inserted into the slot 2 to rest on a further portion 31 of identical cross section to component 10 but which is inserted in the slot 2 in the configuration shown in FIG. 4. A portion 32 of identical cross section to component 20 is inserted into portion 30 and receives a sign 33. A second sign 34 having a thicker cross section is retained in a portion 35 corresponding to component 10 and is spaced from the first sign 33 by a portion 36 which is similar to portion 31. A further spacer portion 37 fills the gap in the slot 2 between the top of the sign 34 and the top of the post 1. A moulded end cap 38 can then be fitted onto the top of the post to complete the assembly.

Portions 30, 31, 35, 36 and 37 may be cut from a single extruded length of material having a cross section identical to that of component 10. Alternatively, if different coloured portions are required, they can be cut from extruded lengths appropriately coloured.

The lengths similar to portion 32 may also be used as spacers in like fashion to that shown in FIG. 7 if the post is only required to take one size of sign e.g. the sign having the smallest thickness in cross section. In such a case, the slot 2 would be lined with a length of component 10 and portions of component 20 would be used to both hold the signs and to space signs one from another.

By cutting appropriate lengths of components 10 and 20, and turning them so as either to be spacers or to receive signs, each sign can be positioned at a desired height from a fixed reference e.g. the base of the post 1.

The post 1 can be mounted on a support member (not shown) for example a pole which passes through the central cavity 7. This allows the slot 2 to be arranged in one of four orientations each spaced apart by 90°.

I claim:

1. A modular sign system for accommodating signs of various thicknesses comprising:

a first nesting component and a second nesting component, each said component including a generally C-shaped recess for nesting and retaining a sign therein, the generally C-shaped recess of said first component also being selectively able to receive and retain said second component in one of a first and a second nested orientation, in said first nested orientation said second component being able to receive and retain a sign in its C-shaped recess, and in said second nested orientation said second component blocking the entrance of a sign into the C-shaped recesses of said first and second components.

2. A modular sign system as in claim 1, wherein each said nesting component has a constant cross section.

3. A modular sign system as in claim 1, wherein said first nesting component is a post of extended length and its C-shaped recess is a longitudinally extending slot.

4. A modular sign system as in claim 1, wherein each nesting component is of extended length, the lengths of said first and second components being one of equal and unequal.

5. A modular sign system as in claim 3, wherein said post has a central longitudinal cavity extending lengthwise therethrough, said cavity being prismatic in a cross section taken transversely to the length of said post, said cavity being subject to receiving therethrough a pole of corresponding cross section, said extended slot being settable at a plurality of orientations relative to said pole.

6. A modular sign system as in claim 5, wherein said cavity is square in cross section.

7. A modular sign system as in claim 1, and further comprising a third nesting component, said third nesting component including a generally C-shaped recess for nesting and retaining a sign therein, the generally C-shaped recess of said second component also being selectively able to receive and retain said third component in one of a first and second nested orientation, in said first nested orientation said third component being able to receive and retain a sign in its C-shaped recess, and in said second nested orientation said third component blocking entrance of a sign into the recesses of said second and third component.

8. A modular sign system as in claim 7, wherein said second component can nest in said first component in said first orientation while concurrently said third component can nest in said second component in one of said first and second orientations of said third component with respect to said second component.

9. A modular sign system as in claim 8, wherein said first nesting component is a post and its C-shaped recess is a longitudinally extending slot into which one of said sign and said second component is selectively received.

10. A modular sign system as in claim 7, wherein each nesting component is of extended length, the lengths of said first and second components being one of equal and unequal.

11. A modular sign system as in claim 9, wherein said post has a central longitudinal cavity extending lengthwise therethrough, said cavity being prismatic in a cross section taken transversely to the length of said post, said cavity being subject to receiving therethrough a pole of corresponding cross section, said extended slot being settable at a plurality of orientations relative to said pole.

12. A modular sign system as in claim 11, wherein said cavity is square in cross section.

* * * * *